US008727742B2

(12) United States Patent
Lee et al.

(10) Patent No.: US 8,727,742 B2
(45) Date of Patent: May 20, 2014

(54) MICRO COMPRESSOR

(75) Inventors: Yong Kwun Lee, Seoul (KR); Soo Jun Lee, Seoul (KR); Hyeon Min Lee, Gunpo-si (KR)

(73) Assignee: Korea Institute of Science and Technology, Seoul (KR)

( * ) Notice: Subject to any disclaimer, the term of this patent is extended or adjusted under 35 U.S.C. 154(b) by 269 days.

(21) Appl. No.: 13/160,656

(22) Filed: Jun. 15, 2011

(65) Prior Publication Data

US 2012/0020813 A1 Jan. 26, 2012

(30) Foreign Application Priority Data

Jul. 20, 2010 (KR) ..... 10-2010-0070195

(51) Int. Cl.

| | |
|---|---|
| ***F04B 1/00*** | (2006.01) |
| ***F04B 1/20*** | (2006.01) |
| ***F04B 1/24*** | (2006.01) |
| ***F04B 27/08*** | (2006.01) |

(52) U.S. Cl.

CPC ... *F04B 1/20* (2013.01); *F04B 1/24* (2013.01); *F04B 27/0839* (2013.01)

USPC ..... 417/269; 417/222.1; 417/271

(58) Field of Classification Search

CPC ..... F04B 1/20; F04B 1/1071; F04B 1/24; F04B 39/0276; F04B 27/0839

USPC ..... 417/222.1, 269, 271; 92/71

See application file for complete search history.

(56) References Cited

U.S. PATENT DOCUMENTS 3,356,037 A 12/1967 North
4,834,694 A * 5/1989 Martin ..... 474/135

(Continued)

FOREIGN PATENT DOCUMENTS

EP 0 974 753 A2 1/2000
FR 1394415 A 4/1954

(Continued)

OTHER PUBLICATIONS

European Search Report issued on Feb. 12, 2011 in corresponding European Patent Application No. 11170579.4-2315.

*Primary Examiner* — Peter J Bertheaud
*Assistant Examiner* — Dominick L Plakkoottam
(74) *Attorney, Agent, or Firm* — NSIP Law

(57) ABSTRACT

A compressor is provided. The compressor includes a housing, a valve plate, a cylinder block, piston units, a cam element, a driving shaft and a motor. The valve plate is fixed to one end of the housing. The cylinder block is rotatable relative to the valve plate and has cylinder bores disposed in a circumferential direction. A portion of the cylinder block is received in the valve plate. The piston units are disposed the cylinder bores. The cam element is fixed to the housing and is in contact with one end of the piston unit. The cam element has an inclined cam surface. One end of the driving shaft is coupled to the cylinder block. The motor is fixed to an opposite end of the housing, while a rotating shaft is coupled to an opposite end of the driving shaft.

8 Claims, 16 Drawing Sheets

(56) References Cited

U.S. PATENT DOCUMENTS

| | | | | |
|---|---|---|---|---|
| 5,231,912 | A * | 8/1993 | Akasaka et al. | 91/499 |
| 5,317,873 | A * | 6/1994 | Okuda et al. | 60/487 |
| 5,333,453 | A * | 8/1994 | Okuda et al. | 60/487 |
| 5,853,052 | A * | 12/1998 | Baiden et al. | 173/15 |
| 6,024,541 | A * | 2/2000 | Perstnev et al. | 417/269 |
| 6,702,908 | B1 * | 3/2004 | Vanderzyden | 148/622 |
| 7,055,320 | B2 * | 6/2006 | Nagai et al. | 60/476 |
| 7,401,588 | B1 * | 7/2008 | Vanderzyden | 123/193.2 |
| 2002/0067993 | A1 * | 6/2002 | Harte et al. | 417/222.1 |
| 2003/0103854 | A1 * | 6/2003 | Kim et al. | 417/501 |
| 2007/0234898 | A1 * | 10/2007 | Boyl-Davis et al. | 91/306 |
| 2009/0041591 | A1 * | 2/2009 | Brisland et al. | 417/269 |

FOREIGN PATENT DOCUMENTS

| | | | |
|---|---|---|---|
| JP | 50-23844 | | 7/1975 |
| JP | 57-168779 | | 4/1981 |
| JP | 02-305379 | | 12/1990 |
| JP | 8-254177 | | 10/1996 |
| JP | 9-287553 | | 4/1997 |
| JP | 2003-254230 | | 9/2003 |
| JP | 2005-90333 | A | 4/2005 |
| KP | 2003-0041578 | A | 5/2003 |
| KR | 10-2000-0002521 | | 1/2000 |
| KR | 10-2003-0068890 | | 8/2003 |
| KR | 10-2006-0119724 | | 11/2006 |
| KR | 10-2007-0003528 | | 1/2007 |
| WO | WO 2005/100788 | A1 | 10/2005 |

* cited by examiner

MICRO COMPRESSOR

CROSS-REFERENCE TO RELATED APPLICATIONS

This application claims priority from Korean Patent Application No. 10-2010-0070195 filed on Jul. 20, 2010, the entire disclosure of which is incorporated herein by reference.

TECHNICAL FIELD

The present disclosure relates to a compressor, which uses pistons driven in a reciprocating motion by electric motors to generate hydraulic power.

BACKGROUND

Compressors consist of bent axis type compressors and swash plate type compressors depending on how the rotating force of a driving shaft is converted to the reciprocating motion of a piston. The bent axis type compressors are configured such that a central axis of the piston is inclined with respect to the centerline of the driving shaft. This is so that as the driving shaft rotates, the piston coupled to the end of the driving shaft reciprocates. The swash plate type compressors are configured such that the central axis of the piston is coaxially aligned with the centerline of the driving shaft. This is so that as the driving shaft rotates, the pistons coupled to a swash plate are in contact with the swash plate to thereby reciprocate. The advantage of the bent axis type compressor is that the capacity can be easily increased by increasing an inclined angle of the piston, whereas the disadvantage is that the size is large since the piston is located within a cylinder block of the inclined driving shaft. On the contrary, the swash plate type compressor has the advantage of being compact in size.

Generally, as the pressure of operation fluid in a compressor increases, the operation condition between parts, which are moved relative to each other, deteriorates. Representative examples are an axial unbalance of force, a sharp variation in pressure in a trapping region, and a wear of the cylinder block and pistons.

FIG. 1 is a conceptual view explaining the pressure applied to a valve plate and a cylinder block according to the prior art. Referring to FIG. 1, the bent axis type compressor includes a valve plate 10, a cylinder block 20 arranged in a line with respect to the valve plate 10, and a piston 30 located in a cylinder bore 21 of the cylinder block 20. The cylinder block 20 is relatively rotatable to the valve plate 10. The valve plate 10 includes: inlet and outlet ports 12 and 11 arranged on the left and right sides of an extension line between top and bottom dead centers; an inner seal land 15 disposed inside the inlet and outlet ports 12 and 11; and an outer seal land 16 disposed outside the inlet and outlet ports 12 and 11. The valve plate 10 has a trapping region for switching between intake and discharge at the respective top and bottom dead centers. Two types of axial force act on the valve plate 10 and the cylinder block 20. A pressing force ($F_p$) of one type is generated so as to force the cylinder block 20 towards the valve plate 10 due to the piston, which moves from the bottom deal point to the top dead center. A separative force ($F_{se}$) of the other type is generated due to an oil film applied on the inner and outer seal lands 15 and 16 of the valve plate 10 sliding. If the pressing force ($F_p$) is greater than the separative force ($F_{se}$) when the compressor operates, then the valve plate 10 and the cylinder block 20 may be in contact with each other, thereby causing abrasion. As a result, a torque loss is generated on the compressor. Also, if the separative force ($F_{se}$) is greater than the pressing force ($F_p$), then the valve plate 10 and the cylinder block 20 may be separated away, thus causing working fluids to leak. Thus, the operation efficiency of the compressor is degraded. While actively performing many researches on the reduction in torque loss and fluid leakage, it has been realized that there is a strong need for the development of a novel combination of the valve plate and the cylinder block.

When the piston 30 is positioned at the trapping region while moving from the outlet port 11 to the inlet port 12, if the piston 30 proceeds with its compression, then the internal pressure of the cylinder bore 21 increases rapidly. Further, when the piston 30 is positioned at the trapping region while moving from the inlet port 12 to the outlet port 11, if the piston 30 proceeds with its expansion, then the internal pressure of the cylinder bore 21 decreases rapidly. That is, a rapid pressure variation is generated before and after the trapping region. To prevent such a pressure variation, as shown in FIG. 1, the outlet port 11 is provided with a notch 13 near the top dead center and the inlet port 12 is provided with a notch 14 near the bottom dead center. However, in case of a micro compressor, there are problems since it is not easy to machine the notches 13 and 14 in the valve plate 10, and the machining costs greatly increase.

FIG. 2 is a cross-sectional view showing a piston according to the prior art. Referring to FIG. 2, the compressor includes a piston 50 located within the cylinder block 40 and a swash plate 60. The piston 50 has a body 51 and a shoe 52. The body 51 and the shoe 52 are coupled with a spherical joint. The body 51 is an elongate cylinder that reciprocates in a cylinder bore 41 of a cylinder block 40. The shoe 52 is smoothly rotatable relative to the body 51. As the cylinder block 40 rotates, it moves along the swash plate 60. To increase the amount of intake and discharge of the compressor, the reciprocating distance (i.e., stroke) of the piston 50 should be increased. The stroke of the piston 50 can be increased by increasing a tilt angle of the swash plate 60. However, in such a case, an angle between the shoe 52 and the body 51 also increases. Thus, the piston 50 is in contact with the cylinder bore 41 at points a and b, which are shown in FIG. 2, thereby causing a lateral force. As a result, the cylinder block 40 and the piston 50 become worn out. That is, it is difficult to miniaturize the compressor while maintaining its performance and capacity.

SUMMARY

According to various aspects, embodiments of a compressor are provided. The compressor includes: a housing; a valve plate; a cylinder block; a plurality of piston unit; a cam element; a driving shaft; and a motor. The valve plate is fixed to one end of the housing. The cylinder block is rotatable relative to the valve plate and has a plurality of cylinder bores disposed in a circumferential direction. A portion of the cylinder block is received in the valve plate. The piston units are disposed within the plurality of cylinder bores. The cam element is fixed to the housing and is in contact with one end of the piston unit. The cam element has an inclined cam surface. The driving shaft is coupled to the cylinder block at one end thereof. The motor is fixed to an opposite end of the housing. A rotating shaft of the motor is coupled to an opposite end of the driving shaft.

In one exemplary embodiment, the valve plate may include: an inlet port; an outlet port; and a plurality of slots. The inlet and outlet ports communicate with the outside. The slot is formed in an inner surface along a circumferential direction of the valve plate and communicates with the inlet and outlet ports. The cylinder block includes a plurality of through holes communicating with the plurality of cylinder bores.

In another exemplary embodiment, the valve plate may include: an inlet port; an outlet port; and a plurality of through holes. The inlet and outlet ports communicate with the outside. The through hole is formed in an inner surface along a lengthwise direction of the valve plate and communicates with the inlet and outlet ports. The cylinder block includes a plurality of rows of slot communicating with the plurality of cylinder bores.

This summary is provided to introduce a selection of concepts in a simplified form that are further described below in the detailed description. This summary is not intended to identify key features or essential features of the claimed subject matter, nor is it intended to be used to determine the scope of the claimed subject matter.

BRIEF DESCRIPTION OF THE DRAWINGS

Arrangements and embodiments may be described in detail with reference to the following drawings in which like reference numerals refer to like elements and wherein.

DETAILED DESCRIPTION

A detailed description may be provided with reference to the accompanying drawings. One of ordinary skill in the art may realize that the following description is illustrative only and is not in any way limiting. Other illustrative embodiments may readily suggest themselves to such skilled persons having the benefit of this disclosure.

Figure 1:
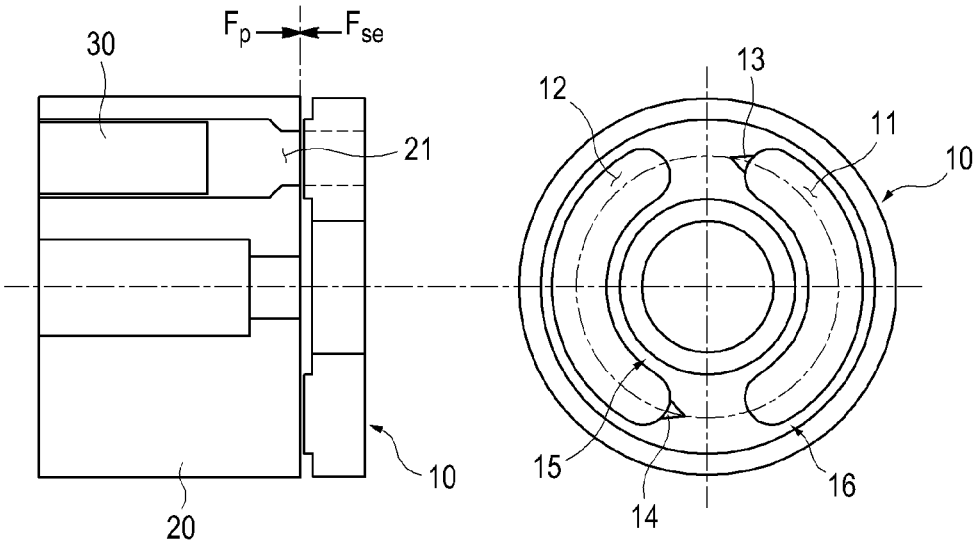
FIG. 1 (PRIOR ART)
FIG. 1 is a conceptual view for explaining the pressure applied to a valve plate and a cylinder block according to the prior art.
Figure 2:
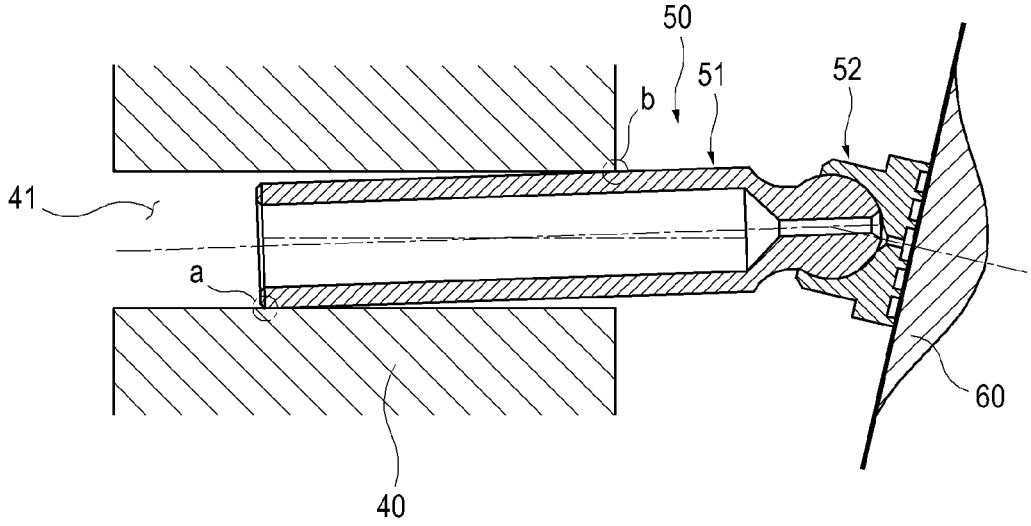
FIG. 2 (PRIOR ART)
FIG. 2 is a cross-sectional view showing a piston according to the prior art.
Figure 3:
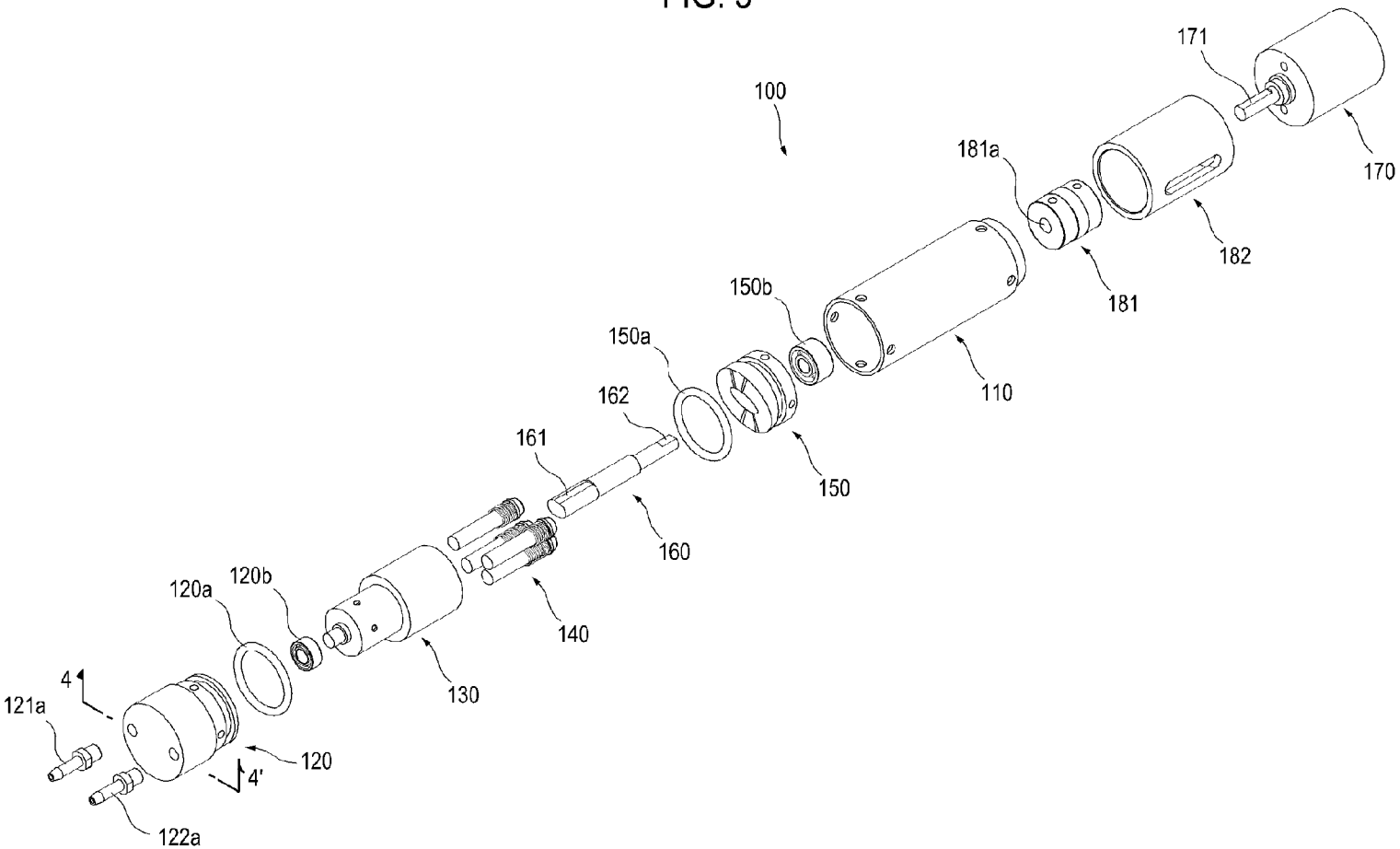
FIG. 3 is an exploded perspective view showing a compressor according to a first embodiment of the present invention.
Figure 4:
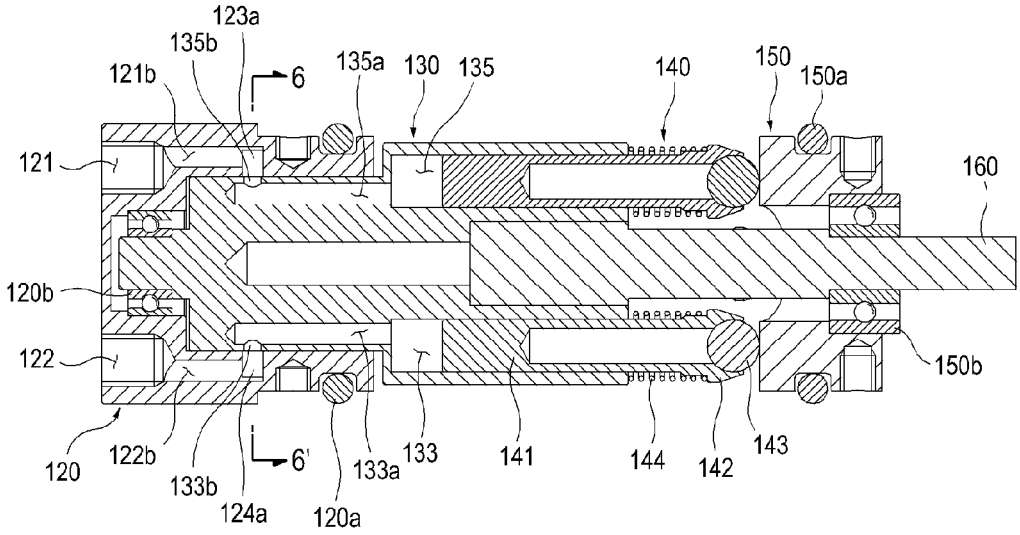
FIG. 4 is a longitudinally-sectional view taken along line 4-4' of FIG. 3 showing the assembly of the compressor.

FIG. 3 is an exploded perspective view showing a compressor according to a first embodiment of the present invention. FIG. 4 is a longitudinally-sectional view taken along line 4-4' of FIG. 3 showing the assembly of the compressor.

Referring to FIGS. 3 and 4, the compressor 100 according to a first embodiment of the present invention includes a housing 110, a valve plate 120, a cylinder block 130, a piston unit 140, a cam element 150, a driving shaft 160 and a motor 170.

The housing 110 is generally shaped like a hollow cylinder that forms a contour of the compressor 100. To opposite ends of the housing, the valve plate 120 and the motor 170 are respectively connected. The cam element 150 is fixed inside the housing 110 at the longitudinally-middle portion of the housing 110. The valve plate 120, the cam element 150, the motor 170 and the like are fastened to the housing 110 by means of a fastener such as a screw or rivet.

Figure 5:
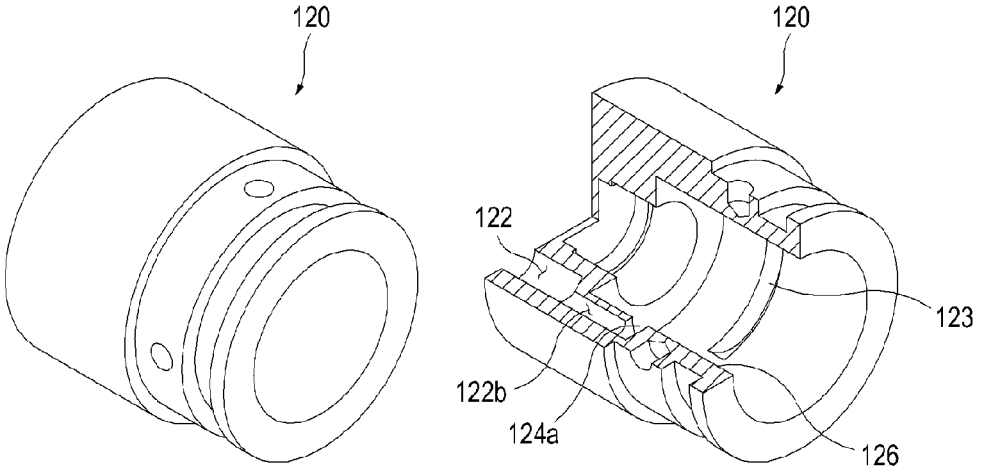
FIG. 5 is a perspective view and a sectional perspective view showing the valve plate of FIG. 3.
Figure 6:
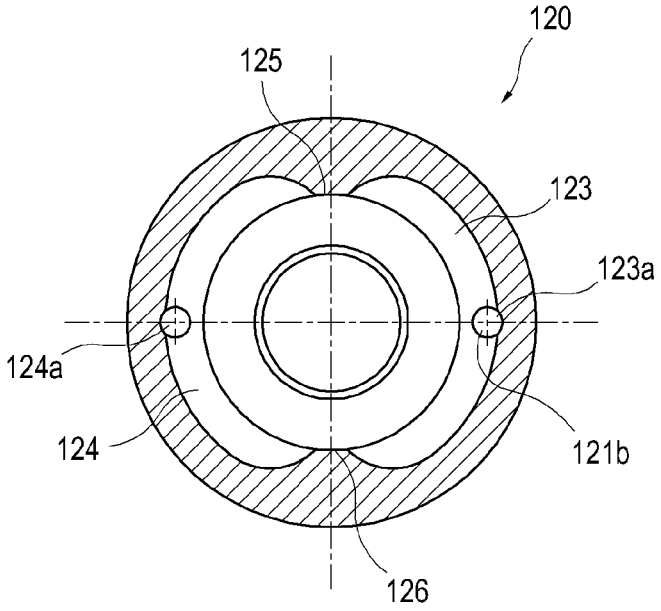
FIG. 6 is a cross-sectional view plate taken along line 6-6' of FIG. 4 showing the valve.

FIG. 5 shows the valve plate in a perspective view and a sectional perspective view. FIG. 6 is a longitudinal cross-sectional view showing the valve plate taken along line 6-6' of FIG. 4.

Referring to FIG. 5, the valve plate 120 is generally shaped like a hollow cylinder having a closed end and an open end. Specifically, the closed end of the valve plate 120 is provided with an inlet port 121 and an outlet port 122, which communicate with the outside (see FIG. 3). The inlet and outlet ports 121, 122 are aligned along line 4-4' of FIG. 3. The inlet port 121 is a passage through which a working fluid is sucked, while the outlet port 122 is a passage through which the working fluid is discharged out in a compressed state. Couplers 121*a*, 122*a* are coupled to the inlet and outlet ports 121, 122 to connect the pipes through which the working fluid flows. In this embodiment, the construction of the inlet and outlet ports 121, 122 is obtained, provided that the driving shaft 160 rotates in a counterclockwise direction. This is so that if the rotating direction of the driving shaft is clockwise, then the inlet and outlet ports may be configured oppositely.

As shown in FIG. 5, slots are formed on an inner surface of the valve plate 120 along a circumferential direction so as to communicate with the inlet and outlet ports 121, 122. The slots consist of a first slot 123 formed in the side of the inlet port 121 and a second slot 124 formed in the side of the outlet port 122. Further, first and second trapping regions 125, 126 are provided in the side of the circumference of the valve plate at positions near the adjacent ends of the first and second slots, i.e., at upper and lower circumferential points along the line that divides a cross-section of the valve plate into two halves side of the inlet ports 121 and the outlet port 122. The first slot 123 is provided with a first through-hole 123*a*, which communicates with the inlet port 121 via a first communication path 121*b*. The second slot 124 is provided with a second through-hole 124*a*, which communicates with the outlet port 122 via a second communication path 122*b*. The first trapping region 125 is a turning point from which a discharge stroke performed through the outlet port 122 is turned to an intake stroke performed through the inlet port 121. Conversely, the second trapping region 126 is a turning point from which the intake stroke through the inlet port 121 is turned to the discharge stroke through the outlet port 122. In this embodiment, the construction of the first and second trapping regions 125, 126 is obtained, provided that the driving shaft 160 rotates in a counterclockwise direction. This is so that if the rotating direction of the driving shaft 160 is clockwise, then the first and second trapping regions may be configured oppositely.

FIG. 6 is a cross-sectional view showing the valve plate taken along line 6-6' of FIG. 4. Referring to FIG. 6, the first and second slots 123, 124 are each formed with a kidney slot in which the depth thereof gradually varies from the first and second trapping regions 125, 126. The term 'kidney slot' is used since the sectional shape of the slot is similar to the shape of the kidney. The depth of the first and second slots 123, 124 gradually increases from the first and second trapping regions 125, 126. Thus, it prevents the intake stroke and the discharge stroke from starting and finishing rapidly before and after the first and second trapping regions 125, 126. That is, the kidney slot can reduce a rapid pressure variation in the trapping regions.

Referring back to FIG. 3, a seal ring 120*a* is mounted around the valve plate 120 to prevent leakage of a working fluid. Further, a bearing 120*b* is mounted inside the valve plate 120 so as to rotatably support the cylinder block 130. Here, an outer race of the bearing 120*b* is fitted inside of the valve plate 120. In this embodiment, the bearing 120*b* may employ a ball bearing, a roller bearing or the like, although the types of bearings are not limited thereto.

Figure 7:
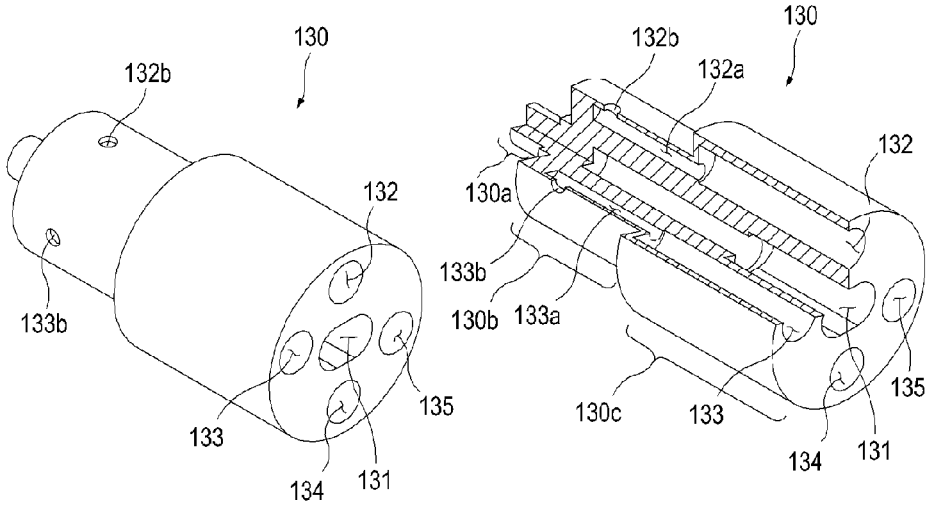
FIG. 7 is a perspective view and a sectional perspective view showing the cylinder block of FIG. 3.

FIG. 7 shows the cylinder block in a perspective view and a sectional perspective view. A portion of the cylinder block 130 is received in the valve plate 120. The cylinder block is rotatable relative to the valve plate 120. Referring to FIG. 7, the cylinder block 130 is generally shaped like a cylinder and comprises first to third sections whose outer diameters are different from each other. The first section 130*a* of the cylinder block 130 is fitted into an inner race of the bearing 120*b*. The second section 130*b* of the cylinder block 130 is received in the valve plate 120 and an outer diameter thereof is formed to correspond to an inner diameter of the valve plate 120. Further, the second section 130*b* is provided with through holes that correspond to the cylinder bore to be described later. The third section 130*c* of the cylinder block 130 is provided with a central axial hole 131 into which the driving shaft 160 is coupled. A plurality of cylinder bores 132, 133, 134, and 135 is circumferentially formed around the central axial hole 131 to receive the piston unit 140 therein. The sectional shape of the axial hole 131 corresponds to that of one end 161 of the driving shaft 160, i.e., a partially facetted shape. While the cylinder block 130 was shown to have four cylinder bores 132 to 135, at least one cylinder bore may be enough. Moreover, in the first embodiment, the cylinder block 130 may have an odd number or even number of cylinder bores. The second section 130*b* of the cylinder block 130 has through holes 132*b*, 133*b*, 134*b*, and 135*b*, which communicate with the respective cylinder bores 132 to 135 via the respective communication passages 132*a*, 133*a*, 134*a*, and 135*a*. The through holes 132*b*, 133*b*, 134*b*, and 135*b* are circumferentially arranged in the circumferential surface of the second section 130*b* of the cylinder block 130. The positions of the through holes 132*b*, 133*b*, 134*b*, and 135*b*, which are located on the second section 130*b* of the cylinder block 130 in a lengthwise direction, correspond to those of the first and second slots 123, 124.

Figure 8:
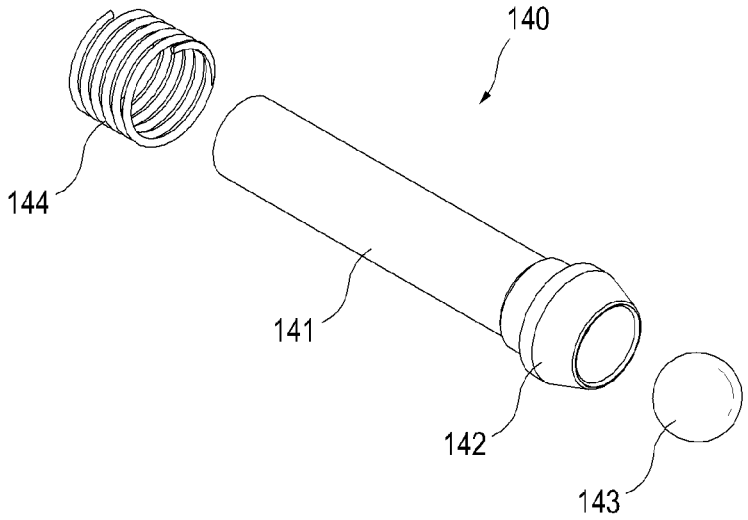
FIG. 8 is an exploded perspective view showing a piston unit of FIG. 3.

FIG. 8 is an exploded perspective view showing the piston unit. The piston unit 140 is inserted within the cylinder bores 132 to 135 to reciprocate. Thus, the number of piston units is the same as the number of cylinder bores. Referring to FIG. 8, the piston unit 140 includes a body 141, a socket 142 formed on an end of the body 141, a ball 143 fitted into the socket 142, and a spring member 144 fitted around the body 141. The body is an elongated cylinder. To reduce the weight of the compressor, the body may be partially formed into a hollow form. The socket 142 has an inner space for receiving the ball 143, and further has an outer diameter larger than the body 141. The ball 143 rolls in the socket 142. The spring member 144 is arranged between the third section 130*c* of the cylinder block 130 and the socket 142 when the piston unit 140 is disposed within the cylinder block 130. Thus, the spring member 144 is compressed and has a compression force as the piston unit 140 moves from a bottom dead center to a top dead center of the cam element 150. Further, the spring member 144 forces the piston unit 140 to be automatically returned when the piston unit 140 moves from the top dead center to the bottom dead center of the cam element 150.

Figure 9:
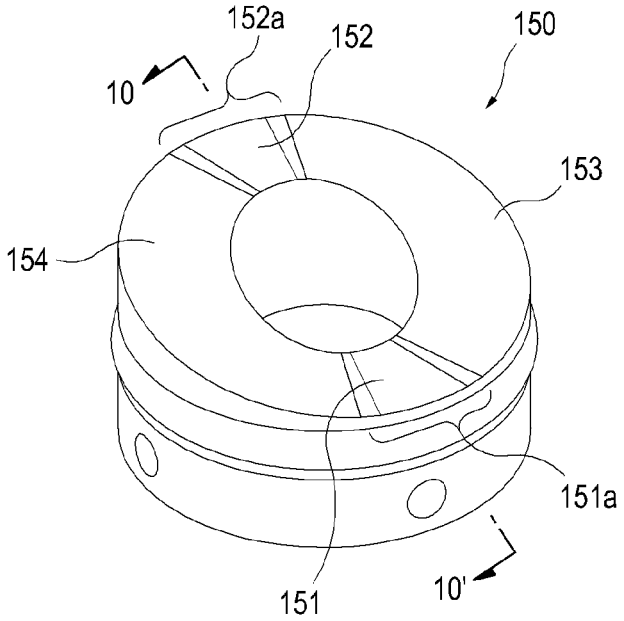
FIG. 9 is a perspective view showing a cam element of FIG. 3.
Figure 10:
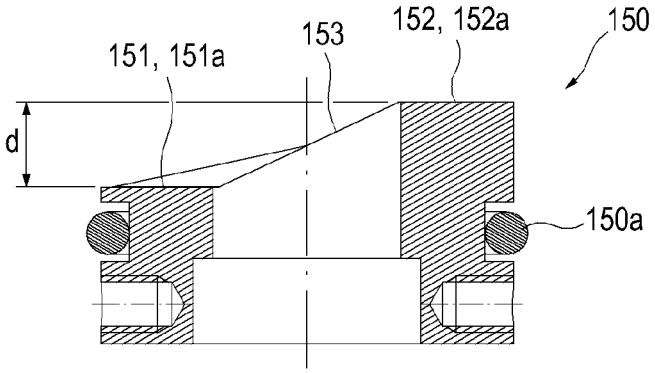
FIG. 10 is a longitudinally-sectional view taken along the line 10-10' of FIG. 9 showing the cam element.
Figure 11:
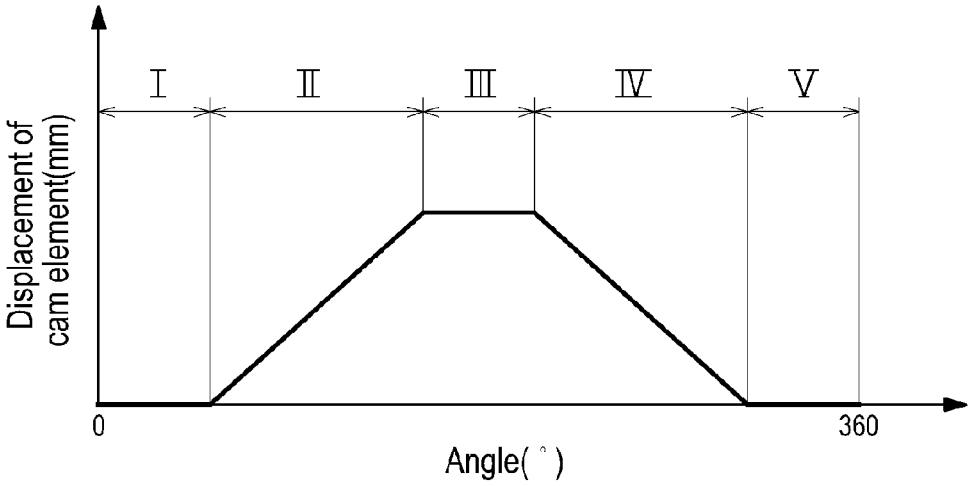
FIG. 11 is a graphical diagram showing a displacement curve of the cam element of FIG. 3.

FIG. 9 is a perspective view showing the cam element. FIG. 10 is a longitudinally-sectional view taken along line 10-10' of FIG. 9 showing the cam element. FIG. 11 is a graphical diagram showing a displacement curve of the cam element.

The cam element 150 is fixed to the housing 110 so as to be in contact with one end of the piston unit 140 and has an inclined cam surface. Referring to FIG. 9, the cam surface of the cam element 150 has a bottom dead center 151 that is a lowest portion of the cam surface, a top dead center 152 that is a highest portion of the cam surface, a rising section 153 extending from the bottom dead center 151 towards the top dead center 152, and a descending section 154 extending from the top dead center 152 towards the bottom dead center 151. Referring to FIG. 10, a distance d (stroke) from the bottom dead center 151 to the top dead center 152 corresponds to a distance that the piston unit 140 reciprocates. The rising section 153 and the descending section 154 may have the same gradient. In this embodiment, the construction of the rising section 153 and the descending section 154 is obtained, provided that the driving shaft 160 rotates in a counterclockwise direction. This is so that if the rotating direction of the driving shaft 160 is clockwise, then the ascending section and the descending section may be configured oppositely. In this embodiment, the cam element 150 may further have stop portions 151*a*, 152*a* (i.e., dwell) formed on the bottom and top dead centers 151, 152. When the through holes 132*b* to 135*b* arrive at the first trapping region 125 or the second trapping region 126, the piston unit 140 is located at the stop portion 151*a* or 152*a* of the bottom dead center 151 or the top dead center 152. Thus, it prevents the piston unit 140 from continuously performing a compressing stroke or an expansion stroke. As a result, a rapid pressure variation occurring before and after the first and second trapping regions 125, 126 can be reduced.

Referring again to FIG. 3, a seal ring 150*a* is mounted around the cam element 150 to prevent leakage of the working fluid. The planar shape of the cam element 150 is generally shaped like a doughnut. A bearing 150 *b* is mounted in the cam element 150 to rotatably support the driving shaft 160. An outer race of the bearing 150*b* is fitted inside of the cam element 150, while the driving shaft 160 is fitted into the inner race of the bearing 150*b*. In this embodiment, the bearing 150*b* may employ a ball bearing, roller bearing or the like, although the types of bearings are not limited thereto.

As shown in FIG. 11, the piston unit 140 has a cycle of stop-rising-stop-descending-stop, while it performs a revolution along the cam element 150. First and fifth sections I and V show the displacement of the piston unit 140 when the piston unit 140 is located at the stop portion 151*a* of the bottom dead center 151. A second section II shows the displacement of the piston unit 140 when the piston unit 140 moves along the rising section 153 extending from the bottom dead center 151 towards the top dead center 152. A third section III shows the displacement of the piston unit 140 when the piston unit 140 is located at the top dead center 152. Further, a fourth section IV shows the displacement of the piston unit 140 when the piston unit 140 moves along the descending section 154 extending from the top dead center 152 towards the bottom dead center 151. The cam element 150 is shown in FIGS. 9 to 11 so that the stop portions 151*a*, 152*a* are definitely depicted. However, it will be apparent to those skilled in the art that regions between the stop portion 151*a* and the rising section 153, between the rising section 153 and the stop portion 152*a*, between the stop portion 152*a* and the descending section 154, and between the descending section 154 and the stop portion 152*a* should have a smooth curved surface to achieve a smooth relative motion between the piston unit 140 and the cam element 150.

The driving shaft 160 is coupled to the axial hole 131 in the cylinder block 130 at one end 161 thereof and to the rotating shaft 171 of the motor 170 at an opposite end 162 thereof. The driving shaft 160 is mounted through the cam element 150 and rotates relative to the cam element 150 via the bearing 150*b*. The motor 170 is fixed to an opposite end of the housing 110. In another embodiment, the motor 170 may be detachably mounted to the opposite end of the housing 110 through a connection member 182. In such a case, the opposite end 162 of the driving shaft 160 is coupled to the rotating shaft 171 of the motor 170 through a coupling 181. The ends 161,162 of the driving shaft 160 and the rotating shaft 171 of the motor 170 have a partially facetted surface to reliably transmit a rotary drive force. The central axial hole 131 in the cylinder block 130 and the axial hole 181*a* of the coupling 181 are formed to correspond to the sectional shape of the ends 161 and 162 of the driving shaft 160 and the rotating shaft 171 of the motor 170.

Hereinafter, the operation of the compressor 100 according to the first embodiment of the present invention will be described. Here, the description will be made, provided that the driving shaft 160 rotates in a counterclockwise direction. This is so that if the rotating direction of the driving shaft 160 is clockwise, then the operation should be understood to be carried out oppositely.

When the rotating shaft 171 of the motor 170 rotates, the driving shaft 160 coupled to the rotating shaft 171 rotates in the same direction as the rotating direction of the rotating shaft 171. Further, the driving shaft 160 rotates relative to the cam element 150 by means of the bearing 150*b* and rotates together with the cylinder block 130. As described above, the cylinder block 130 is rotatably supported by the bearing 120*b* and rotates relative to the valve plate 120. As the cylinder block 130 rotates, a plurality of the piston units 140 disposed within the cylinder bores 132 to 135 rotate along the cam surface of the cam element 150.

When the piston unit 140 moves along the rising section 153 from the stop portion 151*a* of the bottom dead center 151, the piston unit 140 moves away (e.g., in a forward direction) from the cam element 150 to carry out a compression stroke and a discharge stroke. If the piston unit 140 moves forwards, the working fluid in the cylinder bores 132 to 135 is compressed, the compressed working fluid is discharged towards the outlet port 122 through the through-hole 124*a* and the communication path 122*b* when the through holes 132*b*, 133*b*, 134*b*, and 135*b* are located at the second slot 124. Further, in this process, the spring member 144 is compressed and has a compression force. When the piston unit 140 arrives at the stop portion 152*a* of the top dead center 152, the piston unit 140 stop performing the compression stroke and the discharge stroke.

On the contrary, when the piston unit 140 moves along the descending section 154 from the stop portion 152*a* of the top dead center 152, the piston unit 140 moves toward the cam element 150 (e.g., in a backward direction) to carry out an intake stroke. When the piston unit 140 moves backwards, the working fluid is sucked from the inlet port 121 into the cylinder bores 132 to 135 through the communication path 121*b* and the first through-hole 123*a* when the through holes 132*b*, 133*b*, 134*b*, and 135*b* are located at the first slot 123. In this process, the spring member 144 offers the compression force accumulated during the compression stroke to the piston unit 140 so as to assist the movement of the piston unit 140 backwards. When the piston unit 140 arrives at the stop portion 151*a* of the bottom dead center 151, the piston unit 140 stops carrying out an intake stroke.

Figure 12:
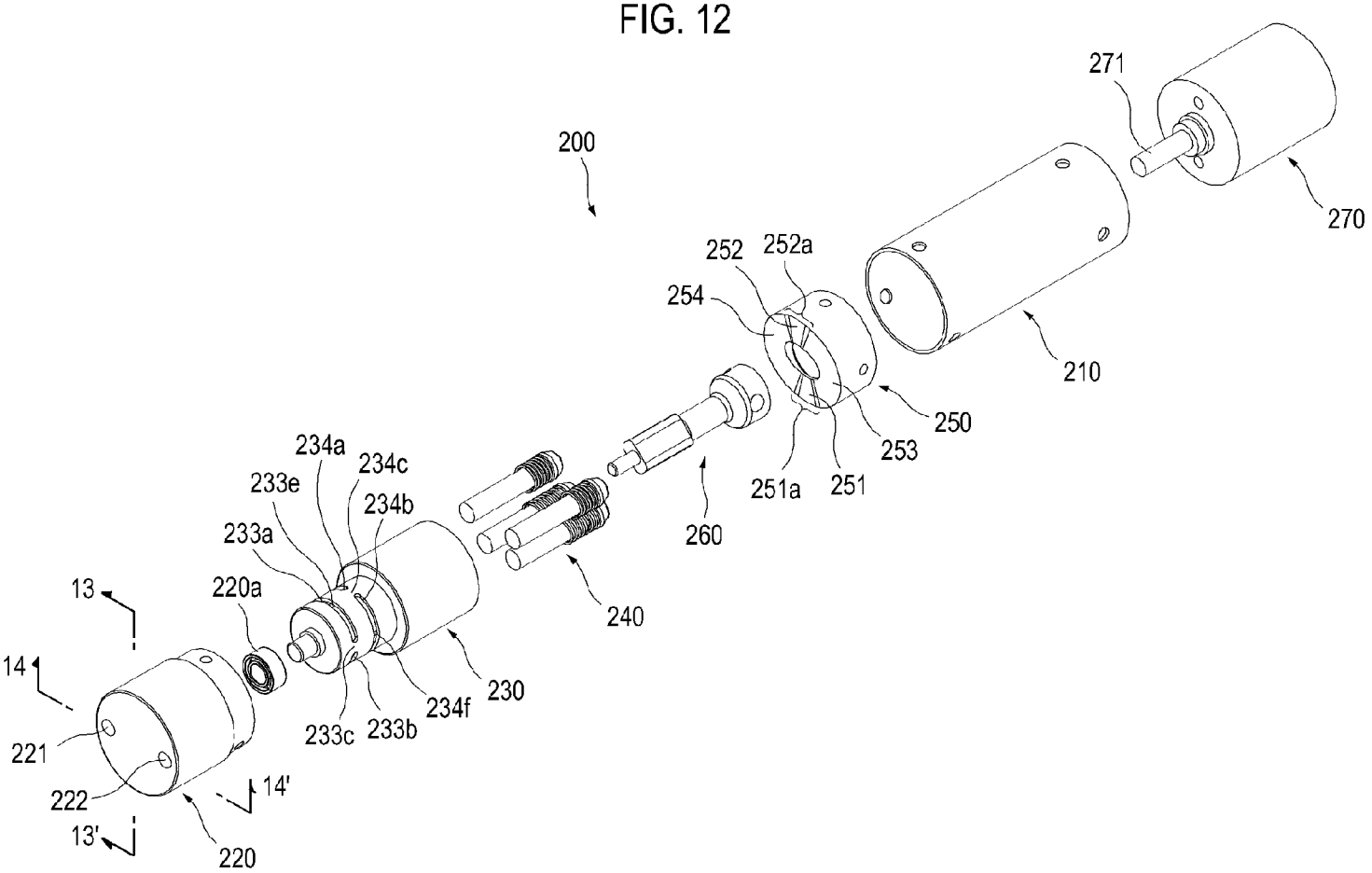
FIG. 12 is an exploded perspective view showing a compressor according to a second embodiment of the present invention.
Figure 13:
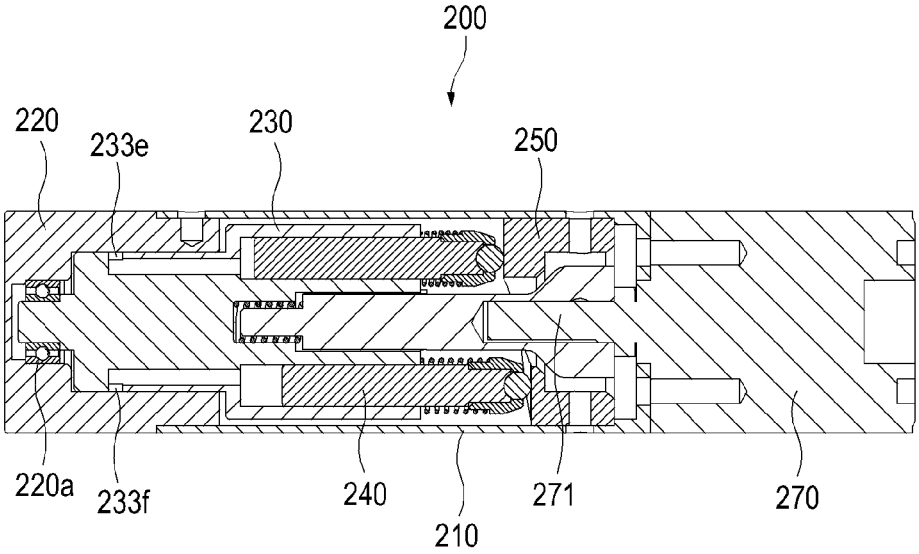
FIG. 13 is a longitudinally-sectional view taken along line 13-13' of FIG. 12 showing the assembly of the compressor.
Figure 14:
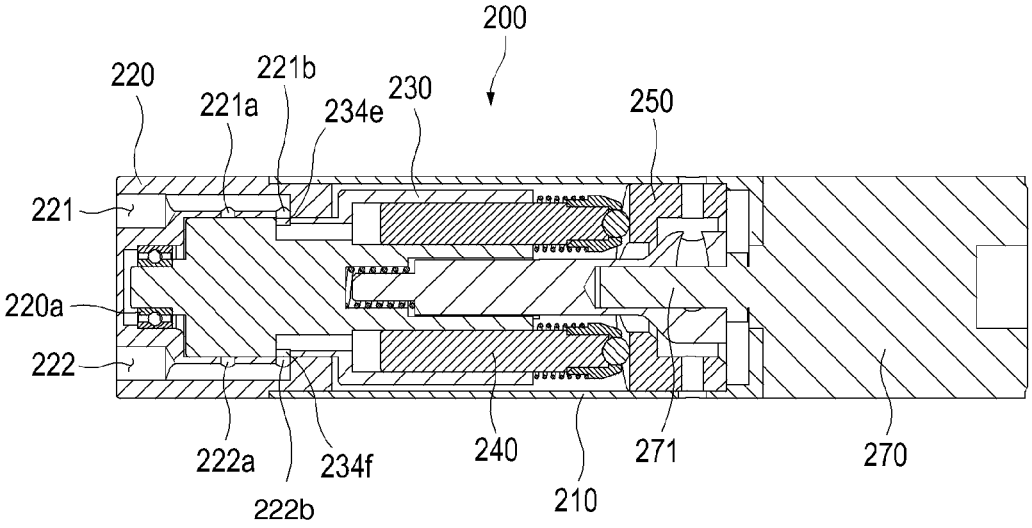
FIG. 14 is a longitudinally-sectional view taken along line 14-14' of FIG. 12 showing the assembly of the compressor.

FIG. 12 is an exploded perspective view showing a compressor according to a second embodiment of the present invention. FIG. 13 is a longitudinally-sectional view taken along line 13-13' of FIG. 12 showing the assembly of the compressor. FIG. 14 is a longitudinally-sectional view taken along line 14-14' of FIG. 12 showing the assembly of the compressor.

Referring to FIGS. 12 to 14, the compressor 200 according to the second embodiment of the present invention includes a housing 210, a valve plate 220, a cylinder block 230, a piston unit 240, a cam element 250, a driving shaft 260 and a motor 270.

The compressor 200 according to the second embodiment has a similar construction to the compressor 100 according to the first embodiment. As such, description will be made in conjunction with different construction while omitting the description on the overlapping construction. For example, the housing 210, the piston unit 240, the cam element 250, the driving shaft 260 and the motor 270 in the second embodiment correspond to the housing 110, the piston unit 140, the cam element 150, the driving shaft 160 and the motor 170 in the first embodiment. However, these elements have the same or similar functions, although they may not be limited to the above-mentioned shape and structure and may be modified within the accepted scope.

Figure 15:
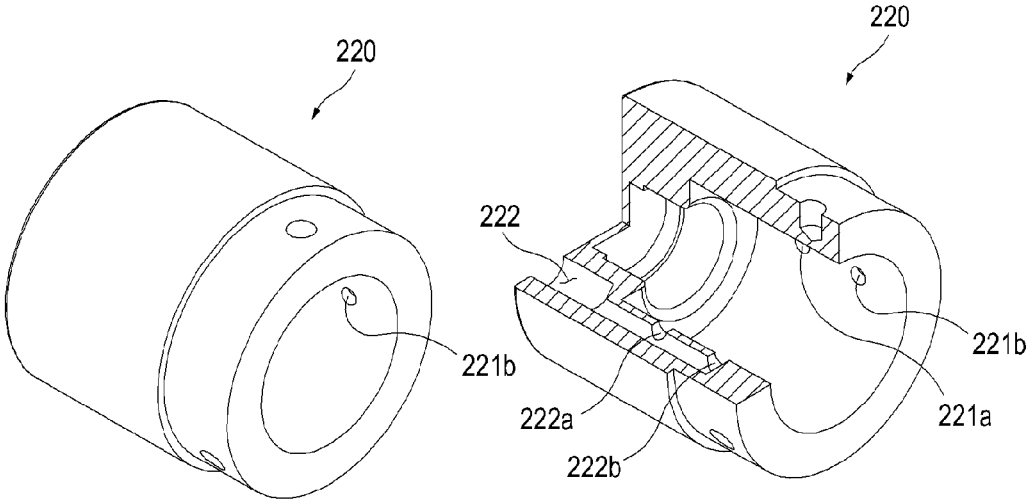
FIG. 15 is a perspective view and a sectional perspective view showing a valve plate of FIG. 12.

FIG. 15 shows the valve plate in a perspective view and a sectional perspective view. Referring to FIGS. 12 and 15, the valve plate 220 is provided with an inlet port 221 and an outlet port 222, which communicate with the outside. The valve plate 220 is provided in an inner surface with a plurality of through-holes 221*a* and 221*b*, 222*a* and 222*b*, which are formed in a lengthwise direction of the valve plate 220 such that they communicate with the inlet and outlet ports 221, 222 of the valve plate 220, respectively. Two through-holes 221*a*, 221*b* are formed through the side of the inlet port 221, while two through-holes 222*a*, 222*b* are formed through the side of the outlet port 222. The number of through-holes is determined by the number of piston units 240.

Figure 16:
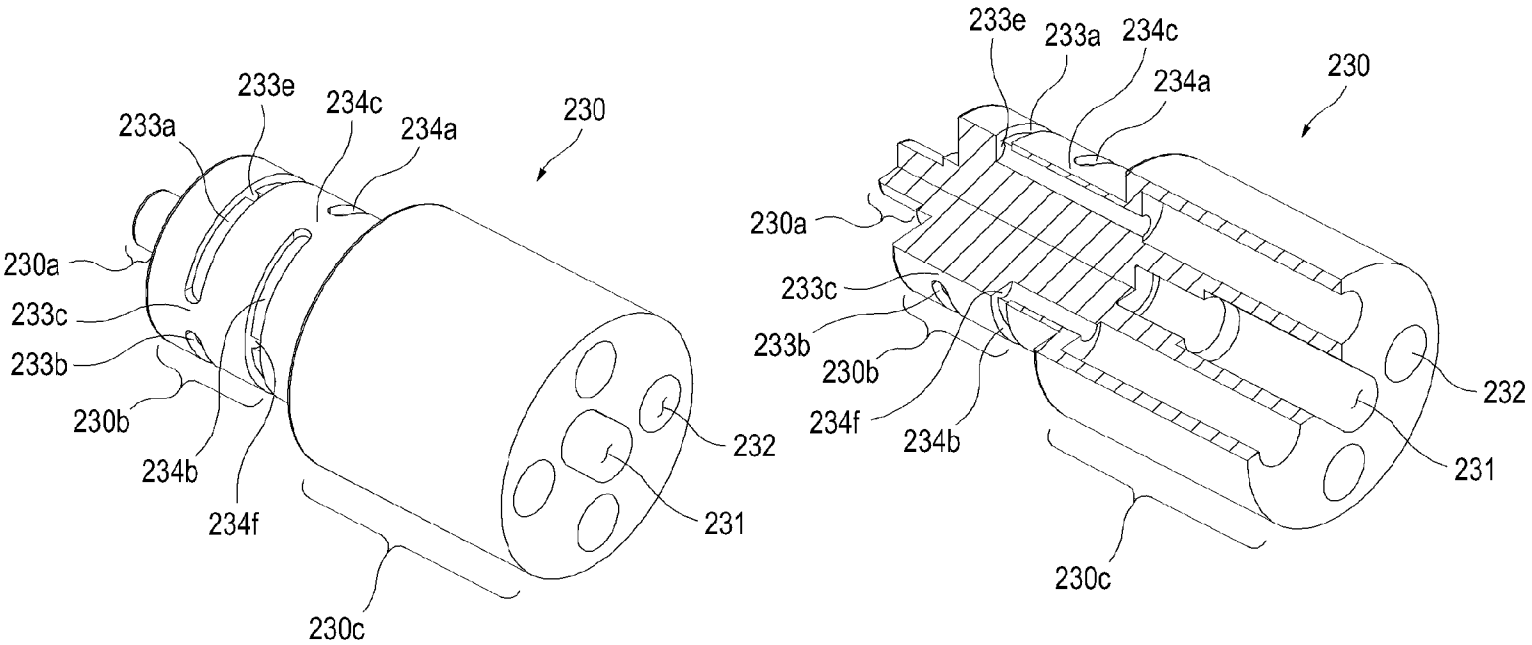
FIG. 16 is a perspective view and a sectional perspective view showing a cylinder block of FIG. 12.

FIG. 16 shows the cylinder block in a perspective view and a sectional perspective view. Similar to the cylinder block 130 of the first embodiment, the cylinder block 230 of the second embodiment is generally shaped like a cylinder and comprises first to third sections whose outer diameters are different from each other. The first section 230*a* in the cylinder block 230 is fitted into an inner race of a bearing 220*a*. The second section 230*b* in the cylinder block 230 is received in the valve plate 220 and an outer diameter thereof is formed to correspond to an inner diameter of the valve plate 220. Further, the second section 230*b* is provided on an outer circumferential surface thereof with rows of slots to communicate with a plurality of cylinder bores 232. The third section 230*c* in the cylinder block 230 is provided with a central axial hole 231 into which the driving shaft 260 is coupled. The plurality of cylinder bores 232 is circumferentially formed around the central axial hole 131 to receive the piston unit 240 therein. The sectional shape of the axial hole 231 corresponds to that of the driving shaft 260, i.e., a partially facetted shape. While the cylinder block 230 was shown to have four cylinder bores 232, the cylinder block may have two or more even number cylinder bores.

In this embodiment, the rows of slots include a first row slot 233 and a second row slot 234. The first row slot 233 includes a first slot 233*a*, a second slot 233*b*, and first and second trapping regions 233*c*, 233*d* between the first slot 233*a* and the second slot 233*b*. The first and second slots 233*a*, 233*b* are respectively provided with through holes 233*e*, 233*f*, which communicate with the cylinder bore 232. The through holes 233*e*, 233*f* are formed substantially in the middle of the first and second slots 233*a*, 233*b*. The first and second slots 233*a*, 233*b* are symmetric with each other about the first and second trapping regions 233*c*, 233*d*, and have a shape that is recessed inwards from the outer circumferential surface of the second section 230*b* in the cylinder block 230. The first and second trapping regions 233*c*, 233*d* correspond to a turning point between an intake stroke and a discharge stroke.

The second row slot 234 includes a first slot 234*a*, a second slot 234*b*, and first and second trapping regions 234*c*, 234*d* between the first slot 234*a* and the second slot 234*b*. The first and second slots 234*a*, 234*b* are respectively provided with through holes 234*e*, 234*f*, which communicate with the cylinder bore 232. The through holes 234*e*, 234*f* are formed substantially in the middle of the first and second slots 234*a*, 234*b*. The first and second slots 234*a*, 234*b* are symmetric with each other about the first and second trapping regions 234*c*, 234*d*, and have a shape that is recessed inwards from the outer circumferential surface of the second section 230*b* in the cylinder block 230. The first and second trapping regions 234*c*, 234*d* correspond to a turning point between an intake stroke and a discharge stroke.

The first and second row slots 233, 234 are arranged such that the first and second trapping regions 233*c*, 233*d* of the first row slot 233 have a phase difference from the first and second trapping regions 234*c*, 234*d* of the second row slot 234. The phase difference is preferably 90 degrees. For example, if the cylinder block has the cylinder bores in which six piston units are received, then three rows of slots may be formed. If so, then the first row slot may have a phase difference of 90 degrees from the second row slot, while the second row slot may have a phase difference of 90 degrees from the third row slot. The first row slot may have the same phase difference as the third row slot. As another example, the first, second and third row slots may be formed to have a phase difference of 60 degrees from each other.

The number of rows of slot is the same as the number of through holes. That is, as shown in FIGS. 13 and 14, the first row slot 233 is formed to correspond to the through-holes 221*a*, 222*a*, while the second row slot 234 is formed to correspond to the through-holes 221*b*, 222*b*. Further, the number of rows of slot or the through-holes corresponds to ½ of the number of cylinder bores. For example, if the number of cylinder bore is six, then it may be configured such that three rows of slots are provided, wherein three through-holes are provided in the side of the inlet port and three through-holes are provided in the side of the outlet port.

Hereinafter, the operation of the compressor 200 according to the second embodiment of the present invention will be described. Here, the description will be made, provided that the driving shaft 260 rotates in a counterclockwise direction, so that if the rotating direction of the driving shaft 260 is clockwise, then the operation should be understood to be carried out oppositely.

When a rotating shaft 271 of the motor 270 rotates, the driving shaft 260 coupled to the rotating shaft 271 rotates in the same direction as the rotating direction of the rotating shaft 271. Further, the driving shaft 260 rotates relative to the cam element 250 and rotates together with the cylinder block 230. The cylinder block 230 is rotatably supported by the bearing 220*a* and rotates relative to the valve plate 220. As the cylinder block 230 rotates, the piston units 240 disposed within the cylinder bores 232 rotate along a cam surface of the cam element 250.

When the piston unit 240 moves along a rising section 253 from a stop portion 251*a* of a bottom dead center 251, the piston unit 240 moves away (e.g., in a forward direction) from the cam element 250 to carry out a compression stroke and a discharge stroke. If the piston unit 240 moves forwards, then a working fluid in the cylinder bores 232 is compressed. The compressed working fluid is discharged towards the outlet port 222 when the through holes 233*e*, 233*f* of the first row slot 233 are located at the through-hole 222*a* of the outlet port 222 or the through holes 234*e*, 234*f* of the second row slot 234 are located at the through-hole 222*b* of the outlet port 222. When the piston unit 240 arrives at a stop portion 252*a* of a top dead center 252, the piston unit 240 stops performing the compression stroke and the discharge stroke.

On the contrary, when the piston unit 240 moves along a descending section 254 from the stop portion 252*a* of the top dead center 252, the piston unit 240 moves towards the cam element 250 (e.g., in a backward direction) to carry out an intake stroke. If the piston unit 240 moves backwards, then the working fluid is sucked from the inlet port 221 into the cylinder bores 232 when the through holes 233*e*, 233*f* of the first row slot 233 are located at the through-hole 221*a* of the inlet port 221 or the through holes 234*b* and 234*f* of the second row slot 234 are located at the through-hole 221*b* of the inlet port 221. When the piston unit 240 arrives at the stop portion 251*a* of the bottom dead center 251, the piston unit 240 stops carrying out an intake stroke.

Although embodiments have been described with reference to a number of illustrative embodiments thereof, it should be understood that various other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a housing;

a valve plate fixed to one end of the housing;

a cylinder block being rotatable relative to the valve plate and having a plurality of cylinder bores;

a plurality of piston units disposed within the plurality of cylinder bores, respectively;

a cam element fixed to the housing and being in contact with each of one end of the piston units, the cam element having an inclined cam surface;

a driving shaft coupled to the cylinder block at one end thereof; and a motor fixed to an opposite end of the housing, a rotating shaft of the motor being coupled to an opposite end of the driving shaft, wherein the valve plate includes an inlet port and an outlet port communicating with an outside, and a plurality of first through-holes formed in an inner surface along a lengthwise direction of the valve plate and communicating with the inlet and outlet ports;

the cylinder block comprises:

a first section being received in the valve plate; and a second section having the plurality of cylinder bores disposed in a circumferential direction;

the first section includes a plurality of rows of slots formed on a circumferential surface of the first section;

the plurality of rows of slots have a shape that is recessed inwards from the outer circumferential surface of the first section, and are provided with second through-holes which communicate with the plurality of cylinder bores; and the positions of the rows of slots in a lengthwise direction of the first section correspond to those of the plurality of first through-holes.

2. The compressor of claim 1, wherein the number of rows of the slots is the same as the number of the through holes along the lengthwise direction of the valve plate.

3. The compressor of claim 2, wherein the number of rows of the slots is half of the number of the cylinder bores.

4. The compressor of claim 1, wherein the slots include a trapping region serving as a turning point between an intake stroke and a discharge stroke.

5. The compressor of claim 4, wherein rows of the slots have phase differences between respective trapping regions.

6. The compressor of claim 4, wherein the slots are formed symmetrically with each other about the trapping region.

7. The compressor of claim 1, wherein the cam element further includes stop portions located on a top dead center and a bottom dead center of the inclined cam surface.

8. The compressor of claim 1, wherein each of the piston units comprises:

a socket formed on one end thereof; and a ball disposed within the socket.

* * * * *